US008105214B2

(12) United States Patent
Jahns

(10) Patent No.: US 8,105,214 B2
(45) Date of Patent: Jan. 31, 2012

(54) COMPACT AND LIGHT EXERCISE MACHINE PROVIDING VARIABLE RESISTANCE AND VARIABLE RANGE OF MOTION

(76) Inventor: Henner Jahns, Los Angeles, CA (US)

( * ) Notice: Subject to any disclaimer, the term of this patent is extended or adjusted under 35 U.S.C. 154(b) by 0 days.

(21) Appl. No.: 12/286,961

(22) Filed: Oct. 3, 2008

(65) Prior Publication Data

US 2009/0093350 A1 Apr. 9, 2009

Related U.S. Application Data

(60) Provisional application No. 60/997,547, filed on Oct. 4, 2007.

(51) Int. Cl.
*A63B 21/22* (2006.01)
*A63B 21/02* (2006.01)

(52) U.S. Cl. ..... 482/110; 482/126

(58) Field of Classification Search ..... 482/110, 482/114, 126, 127, 118–120, 909, 62
See application file for complete search history.

(56) References Cited

U.S. PATENT DOCUMENTS 766,743 A * 8/1904 Terry ..... 482/127
3,647,209 A * 3/1972 La Lanne ..... 482/103
3,885,789 A * 5/1975 Deluty et al. ..... 482/120
4,077,626 A * 3/1978 Newman ..... 482/110
4,384,715 A * 5/1983 Savio et al. ..... 482/128
4,484,741 A * 11/1984 Bingisser ..... 482/114
4,625,962 A * 12/1986 Street ..... 482/116
4,674,741 A * 6/1987 Pasierb et al. ..... 482/72
4,728,102 A * 3/1988 Pauls ..... 482/118
4,830,365 A * 5/1989 March ..... 482/129
5,013,033 A * 5/1991 Watterson et al. ..... 482/72
5,437,591 A * 8/1995 Chen ..... 482/127
5,486,149 A * 1/1996 Smith et al. ..... 482/120
5,876,310 A * 3/1999 Mackey et al. ..... 482/74
6,149,559 A * 11/2000 Mackey ..... 482/124
6,328,677 B1 * 12/2001 Drapeau ..... 482/72
6,659,922 B1 * 12/2003 Yu ..... 482/127
6,857,993 B2 * 2/2005 Yeh ..... 482/92
7,052,440 B2 * 5/2006 Pyles et al. ..... 482/54
2005/0250626 A1 * 11/2005 Charnitski ..... 482/92
2006/0073945 A1 * 4/2006 Zuckerman ..... 482/56
2006/0148622 A1 * 7/2006 Chen ..... 482/72

* cited by examiner

*Primary Examiner* — Allana Lewin
(74) *Attorney, Agent, or Firm* — Aaron P. McGushion

(57) ABSTRACT

A small, light personal fitness device offers capability to perform both light and heavy exercises. The invention employs flywheels (61) to provide continual and variable resistance. The invention includes a method to adjust range of motion and a method to view the operating force of the system. Flywheel unit (3) and the hand unit (9) are attached via a cord (21). Handle (1) is held by hand or by foot. Knob (7) is used to wind the cord manually. Knob (13) is used to adjust the length of the cord. The invention also includes a resistance indicator (31) to show the resistance for each exercise, and to allow the user to monitor the exercising progress and increase in strength.

6 Claims, 12 Drawing Sheets

COMPACT AND LIGHT EXERCISE MACHINE PROVIDING VARIABLE RESISTANCE AND VARIABLE RANGE OF MOTION

CROSS-REFERENCE TO RELATED APPLICATIONS

This application claims the benefit of U.S. Provisional Patent Application 60/997,547 filed on Oct. 4, 2007

BACKGROUND OF THE INVENTION

1. Field of Invention

This invention is a simple, handy, light, and compact exercise machine that provides heavy work out. The invention has a flywheel to maintain resistance along a path of movement. The resistance force is used by a person to create exercises in a variety of ways as well as offer instantaneous change in the amount of resistance made possible by the mechanism. Other exercise devices do not offer a similar combination of form and variable resistance in the manner presented herein.

2. Prior Art

Other exercise machines offering as much exercise capability as the invention disclosed here are heavy, complicated, and take up much space. Strength training requires resistance, which in simplest forms are dead weight or resistance from springs or elastics. The limitation of these types of exercise equipment is that as more or less weight is needed, the user has to stop exercising to change settings, which implies multiple pieces and extra parts.

This invention is an effective tool for providing optimal resistance training with a simple, intuitive, and fun fitness machine. Its "variable resistance mechanism" allows the user to enjoy an uninterrupted workout while maintaining the desired resistance at all times.

U.S. Pat. No. 5,512,028 to Sparks, III (1996) shows a device that uses a flywheel for resistance purposes, but offers a symmetrical design without a range of motion adjustment.

U.S. Pat. No. 6,283,899 B1 to Charnitski (2001) illustrates a flywheel exerciser with a different method of weight calibration and a large rack system for adjustment.

U.S. Pat. No. 6,780,144 B2 to Stevens (2004) demonstrates a fitness device with a similar form and yet differs in the inclusion of adjustable length range of motion and a permanent handle for securing the flywheel side of the device.

No fitness device is designed with the specific combination of flywheel, feedback indicator, and adjustability of this device. The combination of design form and particular functions makes this product unique for providing continual and instantaneous adjustment of exercise resistance.

SUMMARY OF THE INVENTION

The object of this invention is to provide a small exercise system that provides a big workout.

The invention disclosed herein is a fitness device with a body housing a flywheel and a cord pulled away from it with a handle to achieve the resistance for the exercise. The device contains a method to view the amount of resistance the motion is operating under and a method for adjusting the cord length to establish the range of motion. Both the side with the flywheel apparatus and the handle only side maybe held by the operators hand or foot.

In summary, this invention provides:

Light to heavy exercise
Exercise for major upper and lower body muscles
Compactness
Variable resistance
Variable range of motion Means to indicate resistance for each exercise
Ease of use, and being handy to use
Simplicity
Portability
Sleek industrial design The device's cord length is adjustable to provide the appropriate range of motion.

The device also offers additional foot and handle attachments to make it possible to hold it with both hands and exercise.

MERITS OF THE INVENTION

Today's exercise machines use elastics, springs, or weights to provide resistive force to muscles.

The invention disclosed herein provides resistance by means of a flywheel. Inertia is defined as resistance to change in motion. Flywheels have large rotational inertia that provides resistance. Key difference of flywheels and tensile resistive and weight machines is that flywheel systems offer variable resistance delivered instantly upon demand by the user. The greater the force with which the user pulls on the flywheels, the greater the resistive force she or he will experience. The device offers low to high resistance (variable resistance) instantly without changing any weights or settings.

This invention provides lower and upper body workout for major muscles. It is light and compact making it ideal for home use and travel. It is small enough to fit in a shoebox and has the weight of a single hand weight, and yet provides as much exercising capability as large exercise machines many times its weight and size. The invention has clear "force feedback" to indicate the intensity of the workout. The design of the invention provides a smooth and quite operation. It requires no adjustments, settings, or calibration. This invention uses two flywheels for balanced weight distribution.

The above features make the invention disclosed herein fun and enjoyable, thus making exercising more frequent by user.

DETAILED DESCRIPTION OF THE PREFERRED EMBODIMENTS OF THE INVENTION

Figure 1:
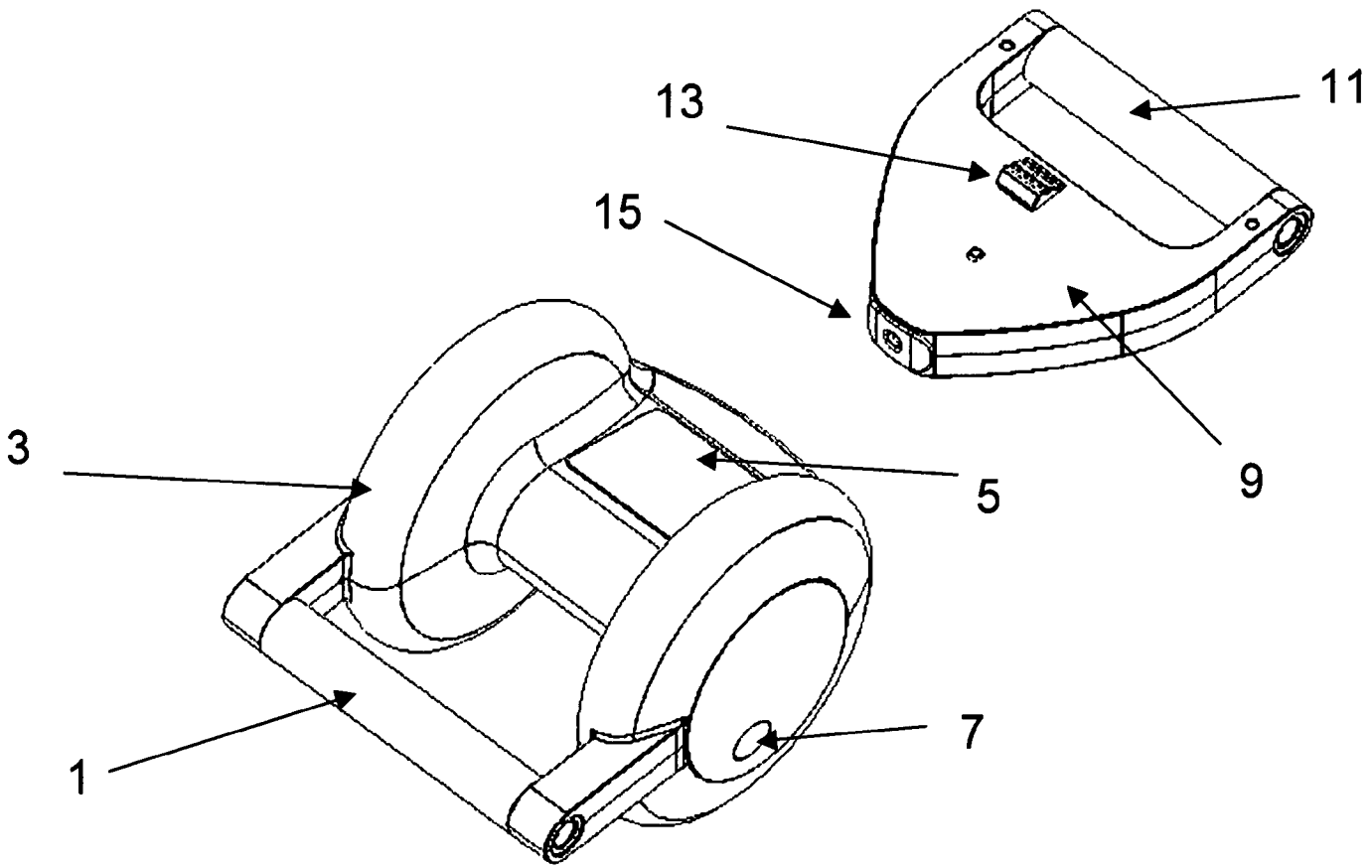
FIG. 1 shows an isometric view of the invention and its two main parts.

FIG. 1 Flywheel unit (3) and the hand unit (9) are shown. The cord that attaches the two units is now shown. Handle (1) is shown on the flywheel unit, which can be held by hand, or by foot. See-through window (5) allows the user to see the cord being wounded and see the rotation of the flywheels. Knob (7) is used to wind the cord manually. Opening (15) on the hand portion is for the cord to go inside the unit. Cord length adjustment knob (13) is also shown. This cord is pushed, the cord length is adjusted, and the knob is then released.

Figure 2:
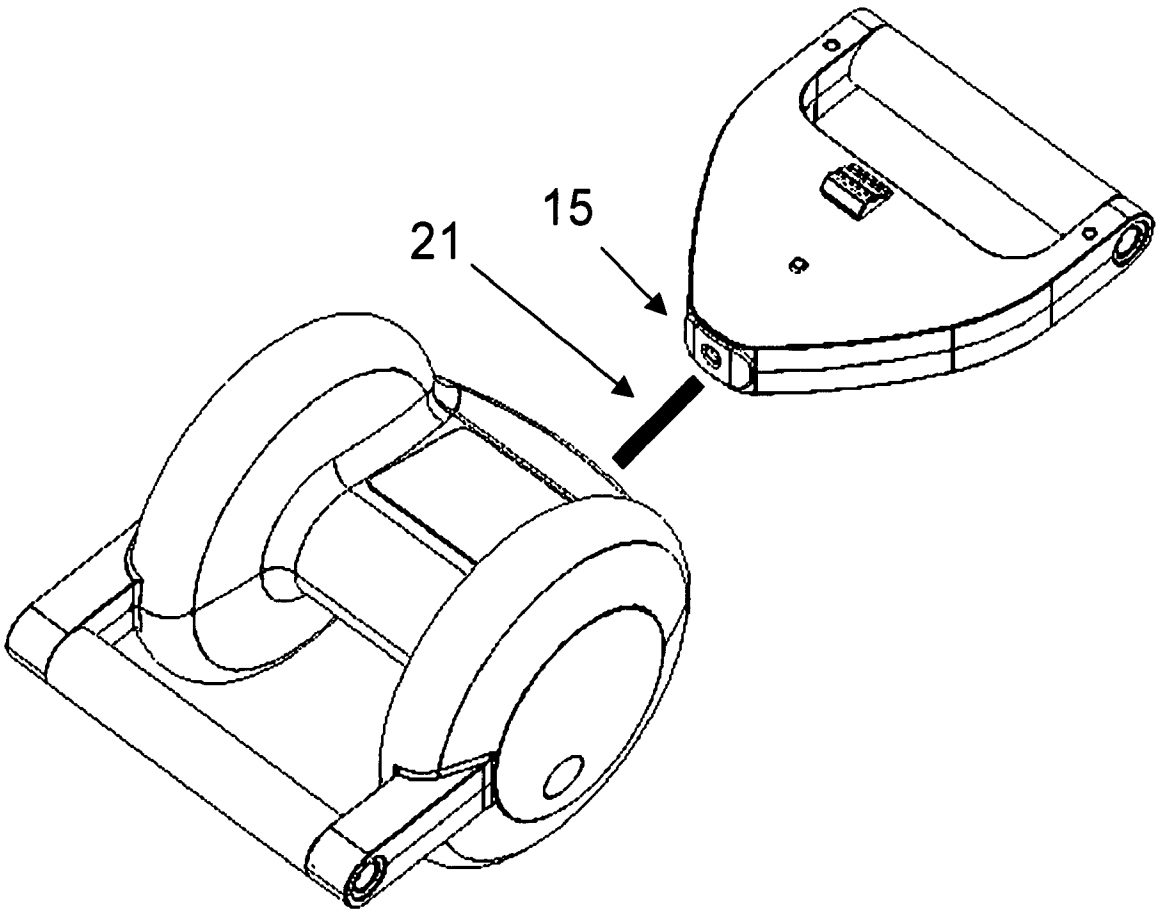
FIG. 2 shows the two parts with a rope or cord in between the two units.

FIG. 2 shows cord (21) between the two units and the opening (15) through which the cord goes inside the hand unit of the invention.

Figure 3:
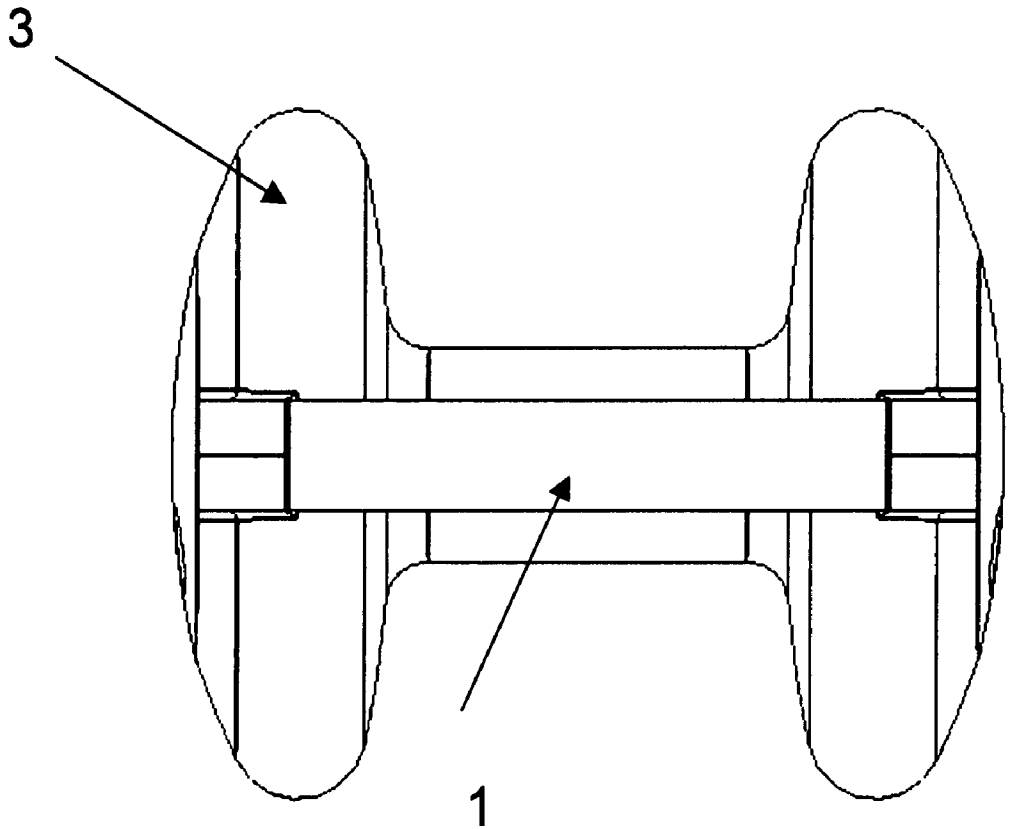
FIG. 3 shows a side view of the unit that houses the two flywheels.

FIG. 3 shows a side view showing the flywheel housing unit (3) and the handle of the flywheel unit (1).

Figure 4:
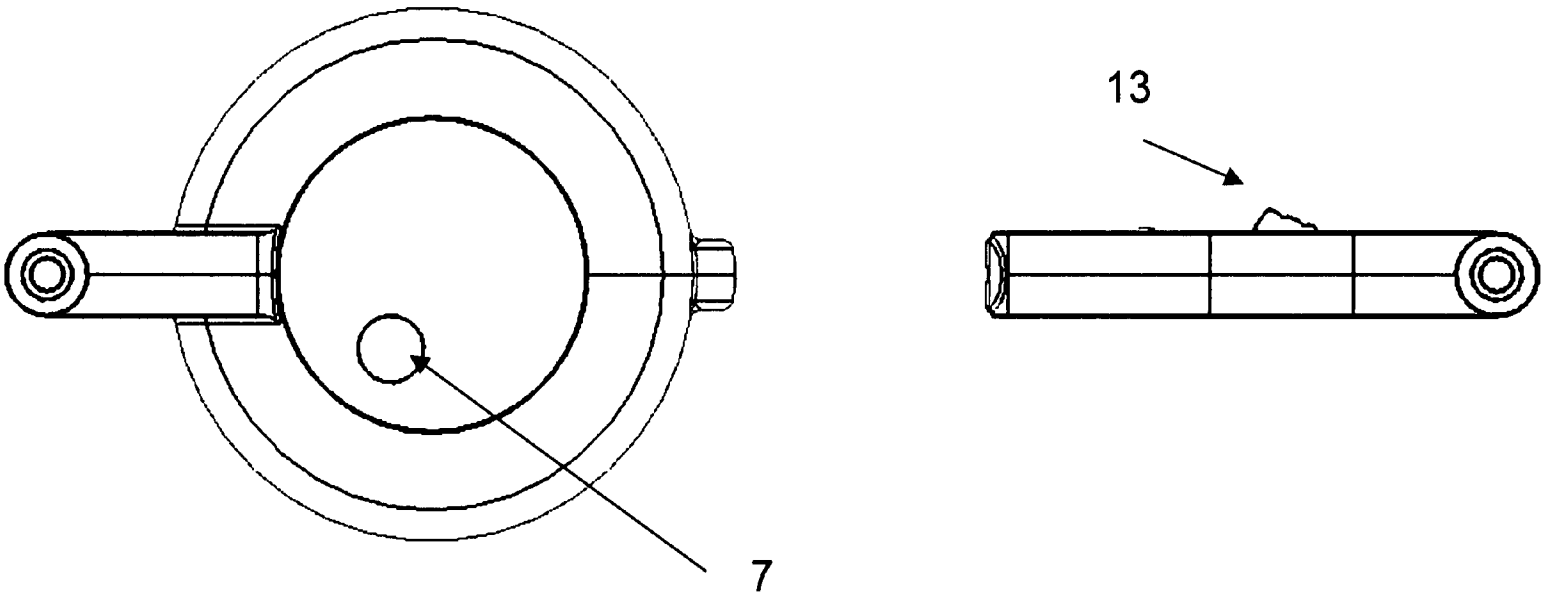
FIG. 4 shows a side of the two units.

FIG. 4 shows another side view of the invention. Cord winder knob (7) is shown and the cord length adjustment know (13) is also shown.

Figure 5:
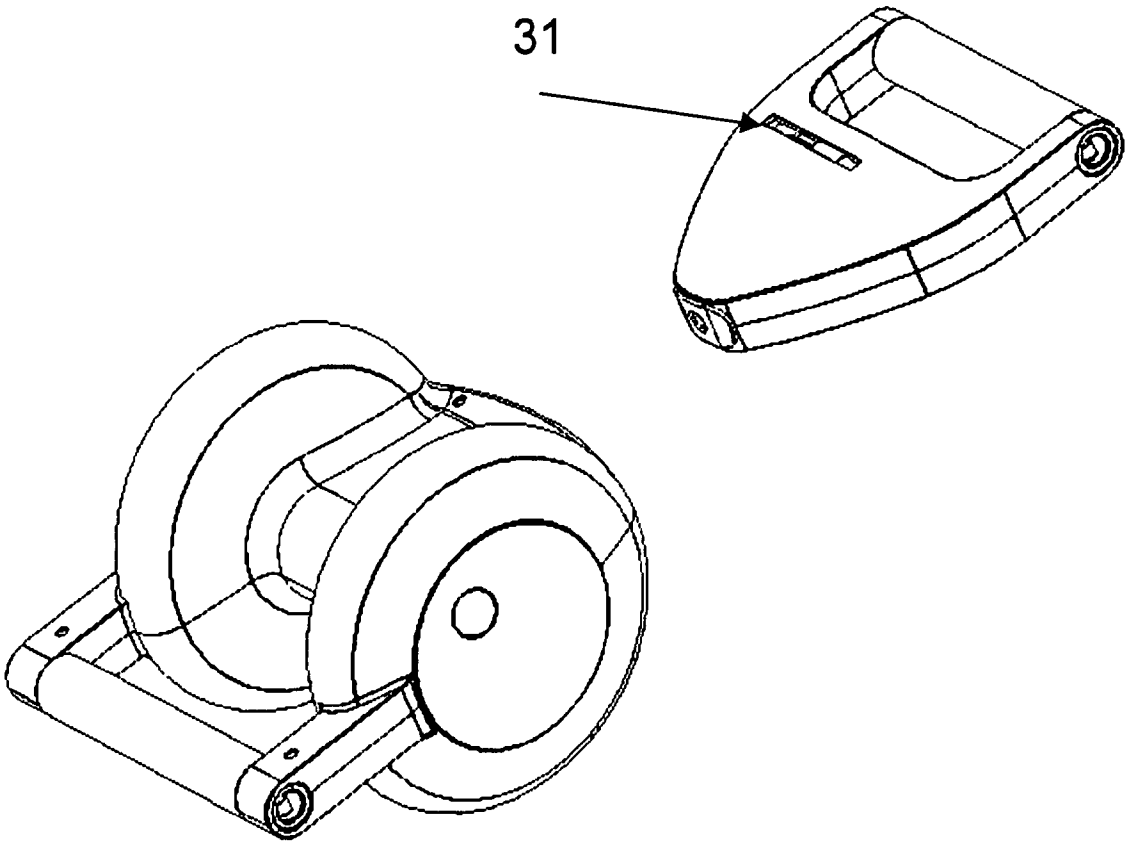
FIG. 5 shows the two units of the invention but with the handle portion turned to show the resistance indicator.

FIG. 5 shows an isometric view of the invention with the resistance indicator (31).

Figure 6:
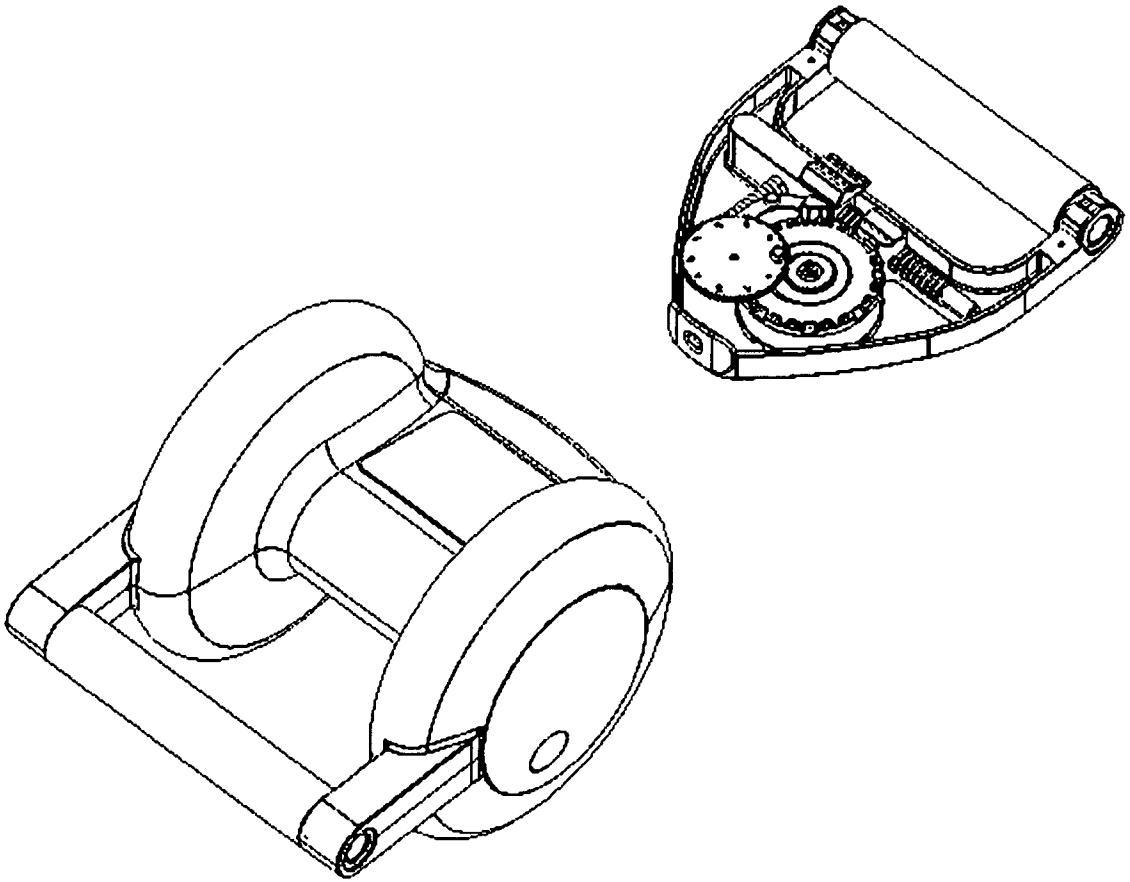
FIG. 6 shows the two units of the invention with the handle cover removed to expose the inner working of the handle unit.

FIG. 6 shows an isometric view of the invention with the handle unit cover removed.

Figure 7:
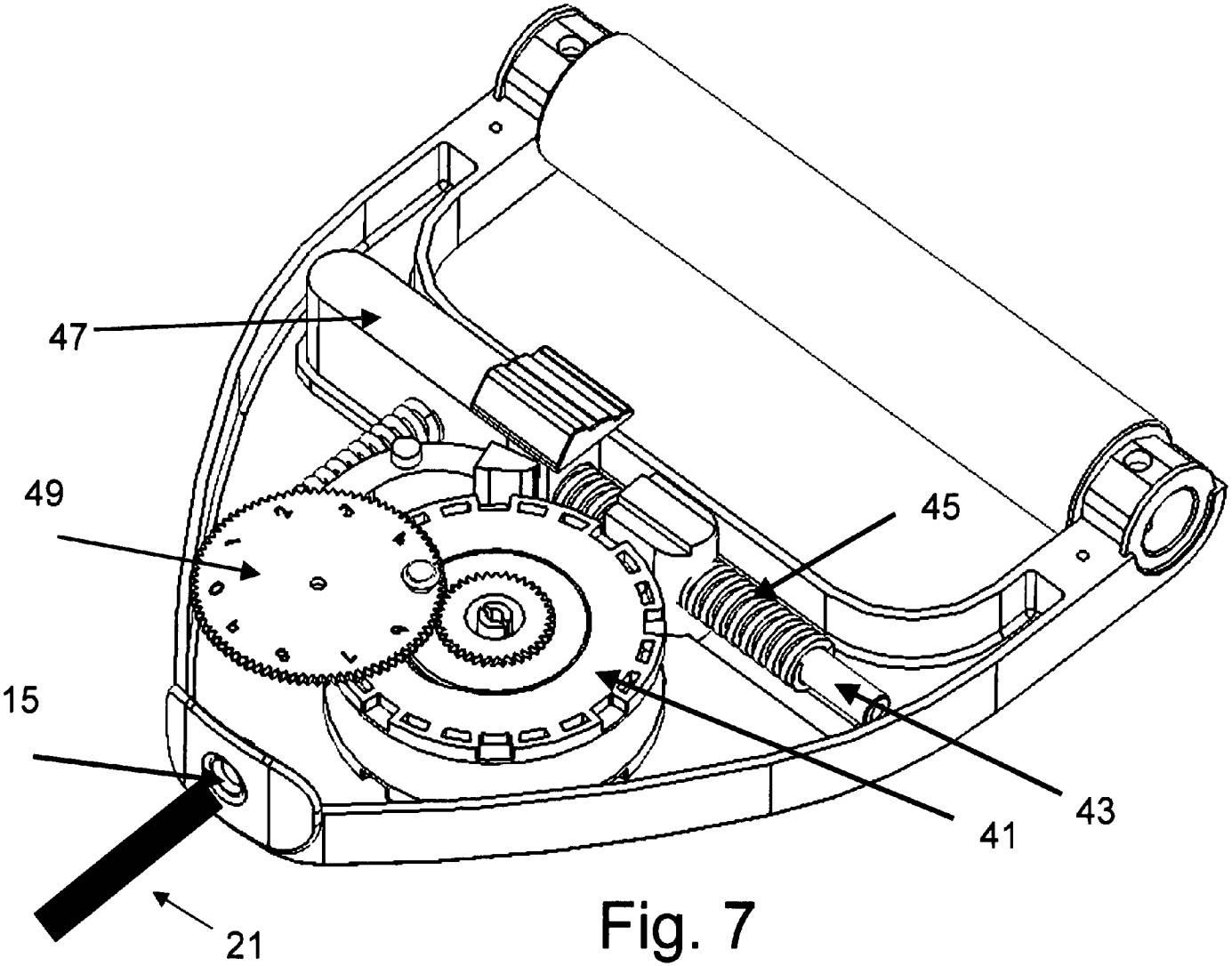
FIG. 7 shows an enlarged isometric view of the handle unit's inside design.

FIG. 7 shows a detailed view of the inside of the hand unit. Cord (21) is shown outside of the unit. The cord is not shown inside of the unit to expose the various components. The opening (15) is shown where the cord goes inside the unit. The cord retraction wheel (41) is shown. This wheel can be locked in position. The spring block (47) is shown which slides on the sliding block (43). The sliding block (43) will slide along the track and compress spring (45). Cord length indication wheel (49) is also shown. The length indication wheel (49) has numbers for each position of the cord length. The corresponding number to each position of the cord length will be displayed through a window in the handle housing allowing the user to see what current length the cord has. The arrangement shown also acts as a shock absorber in case the handle assembly hits the flywheel housing unit (3) after the moment of inertia is applied and NOT reduced by manual force by the user.

Figure 8:
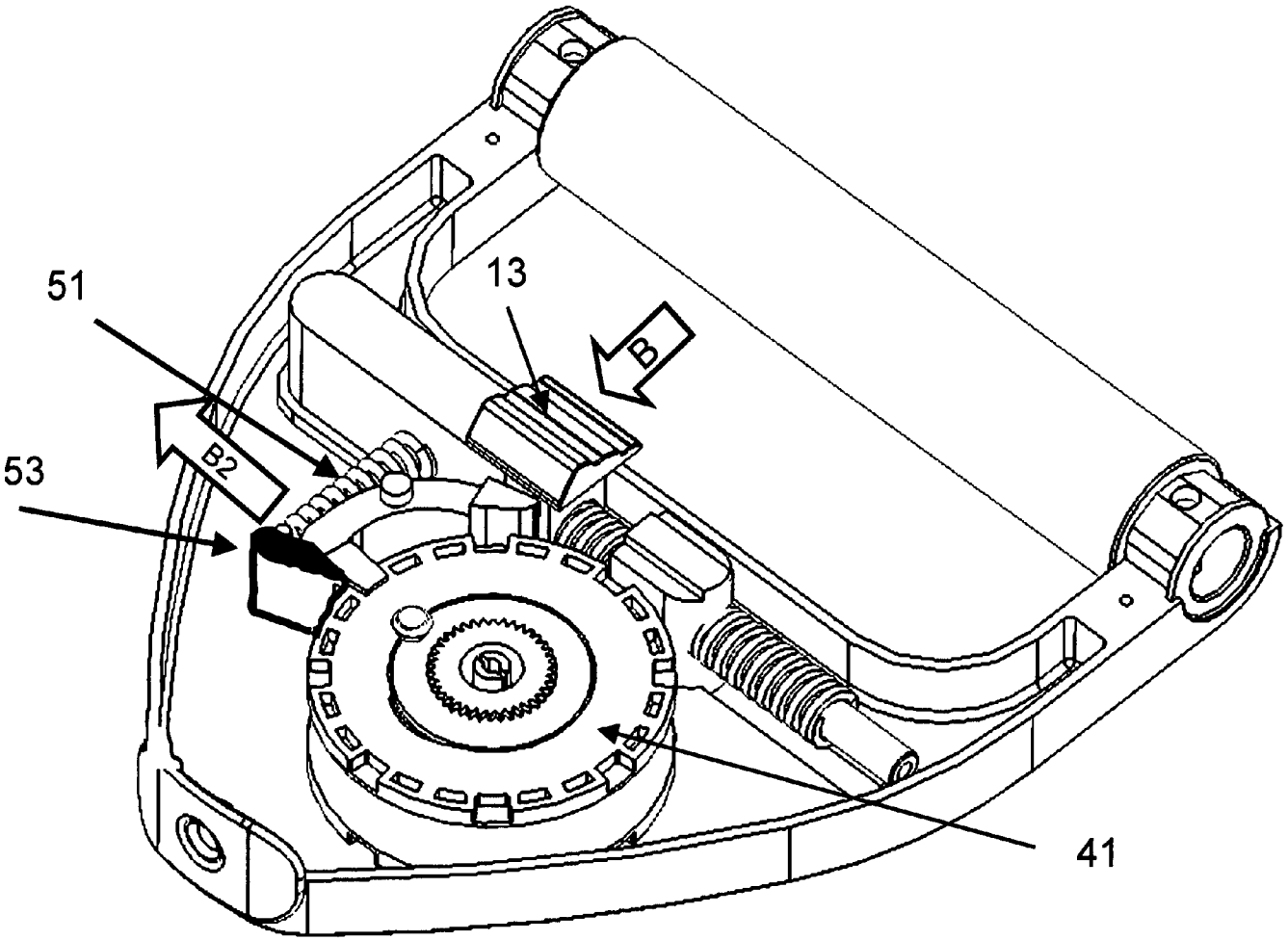
FIG. 8 shows an enlarged view of the handle unit's inside with the cord length indicator Removed to expose more of the inner workings of the system.

FIG. 8 shows the handle unit with the cord length indication wheel not shown to reveal the components below. The cord retraction wheel (41) is kept in a locked position through the force of the lever spring (51) pushing on the pivoted lever (53) which shape locks into the outer contour of the cord retraction wheel (41). When the release button (13) is pushed in the direction of (B) it pushes against the pivoted lever (53) which will rotate and move the locking end away from the cord retraction wheel (41). When the assembly is in this released position the cord can either be pulled in the outside of the unit and it will unwind itself from the retraction wheel (41) and increase its length or it will wind itself up on the spring loaded cord retraction wheel (41) and reduce its length. The cord retraction wheel (41) turns the integrated gear linked to the length indication wheel and will also turn the length indication wheel.

Figure 9:
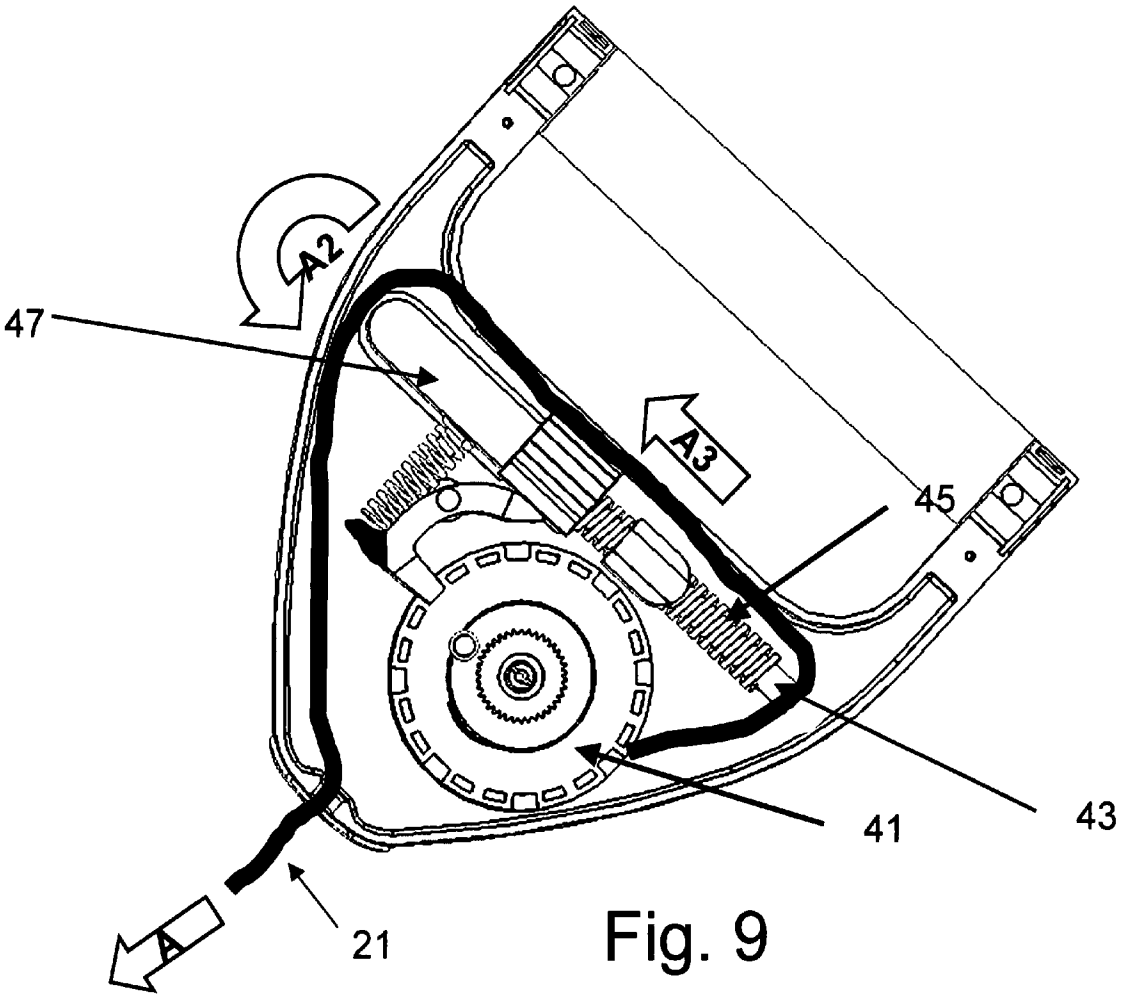
FIG. 9 shows a plan view of the inside of the handle, and the cord inside and how it is placed inside the unit and how it transfers force.

FIG. 9 shows a plan view of the handle unit's inside. This figure shows the cord (21) and its connection arrangement inside the unit. This figure shows the forces the cord (21) exerts as it is being pulled. When the cord retraction wheel (41) is in the locked position and the cord (21) is being pulled (A) the force will translate through the cord (21) around the rounded corner (A2) of the spring block (47) on the sliding block (43). The sliding block (43) will slide along the track (A3) in the housing and compress the spring (45). The travel (A3) of the sliding block (43) is translated to a visual indication of the force that is being applied on the cord (21) in the direction (A) equaling the compression of the spring. There is an opening on the handheld unit (shown in FIG. 5) that allows the user to see the force being applied.

Figure 10:
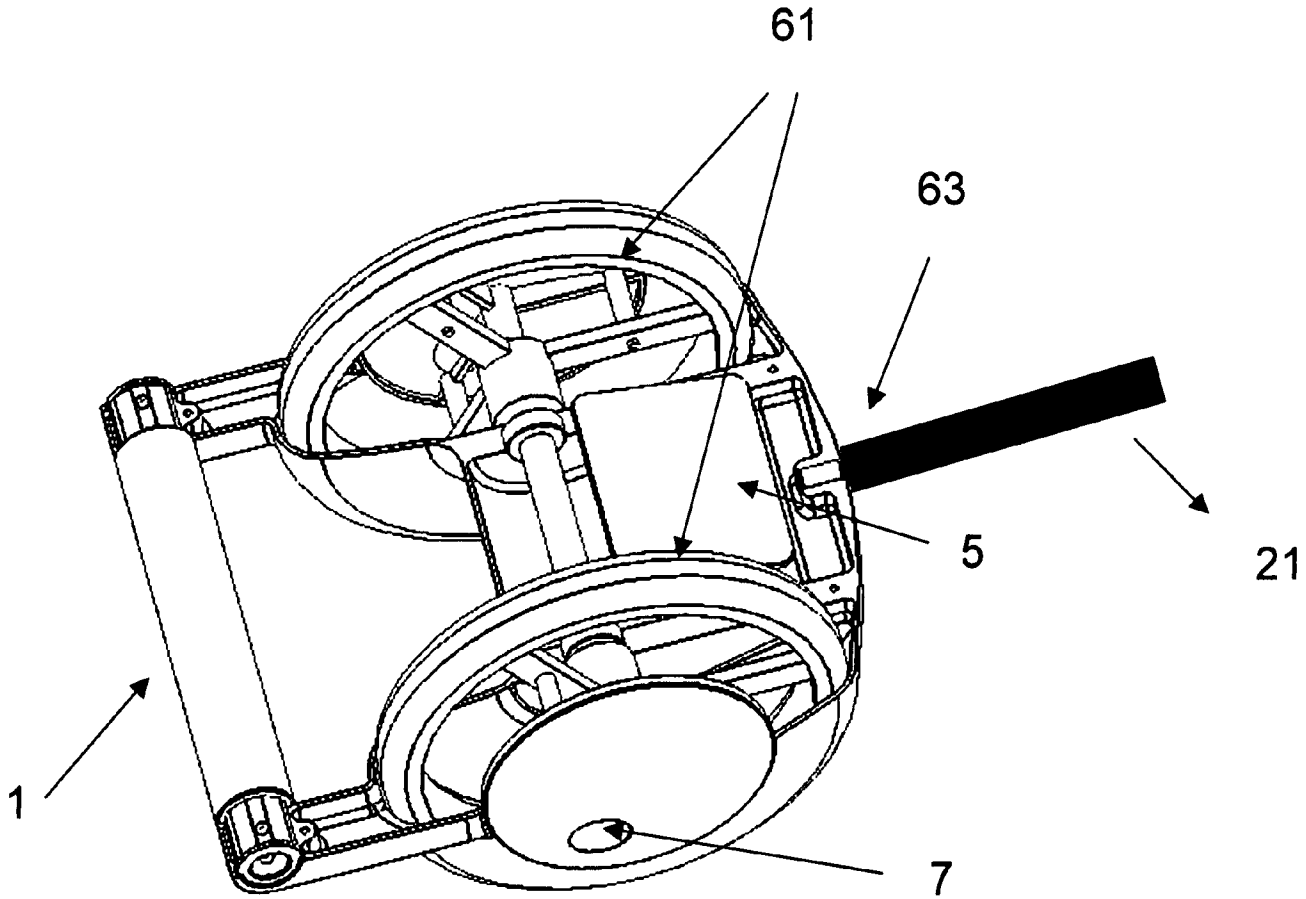
FIG. 10 shows the flywheel part of the device partially exposed.

FIG. 10 shows an isometric view of the flywheel unit. The cover of the unit has been partially shown to reveal the two flywheel units (61). Window (5) to view the flywheels and the cord is shown. Cord (21) is shown going through the opening (63). Using the knob (7) the user can manually retract and wind the cord in the flywheel unit.

Figure 11:
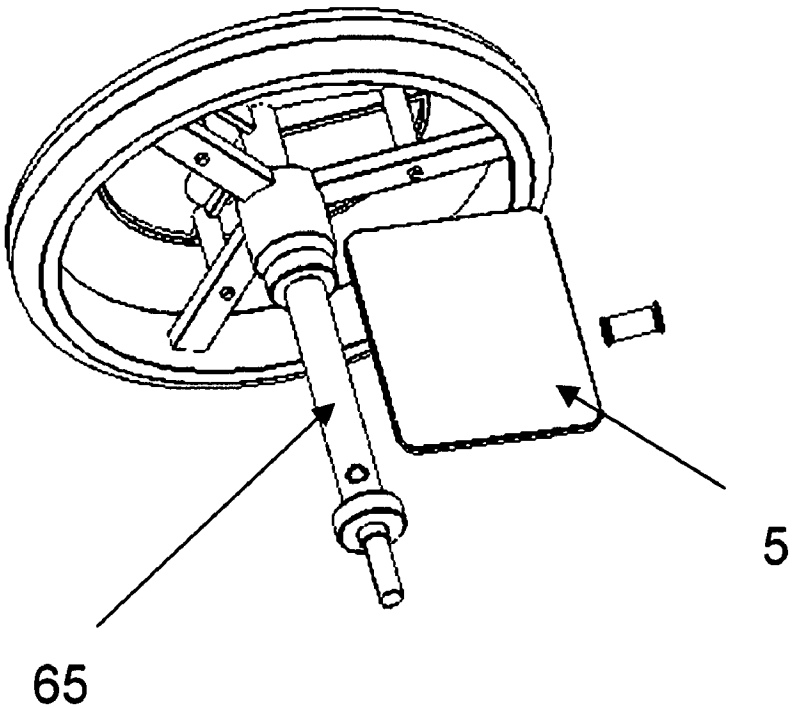
FIG. 11 shows the flywheel part of the device more exposed.

FIG. 11 Shows the flywheel and the window (5) and the axle (65) that connects the two flywheels together. Cord (21) winds around this axle (65).

Figure 12:
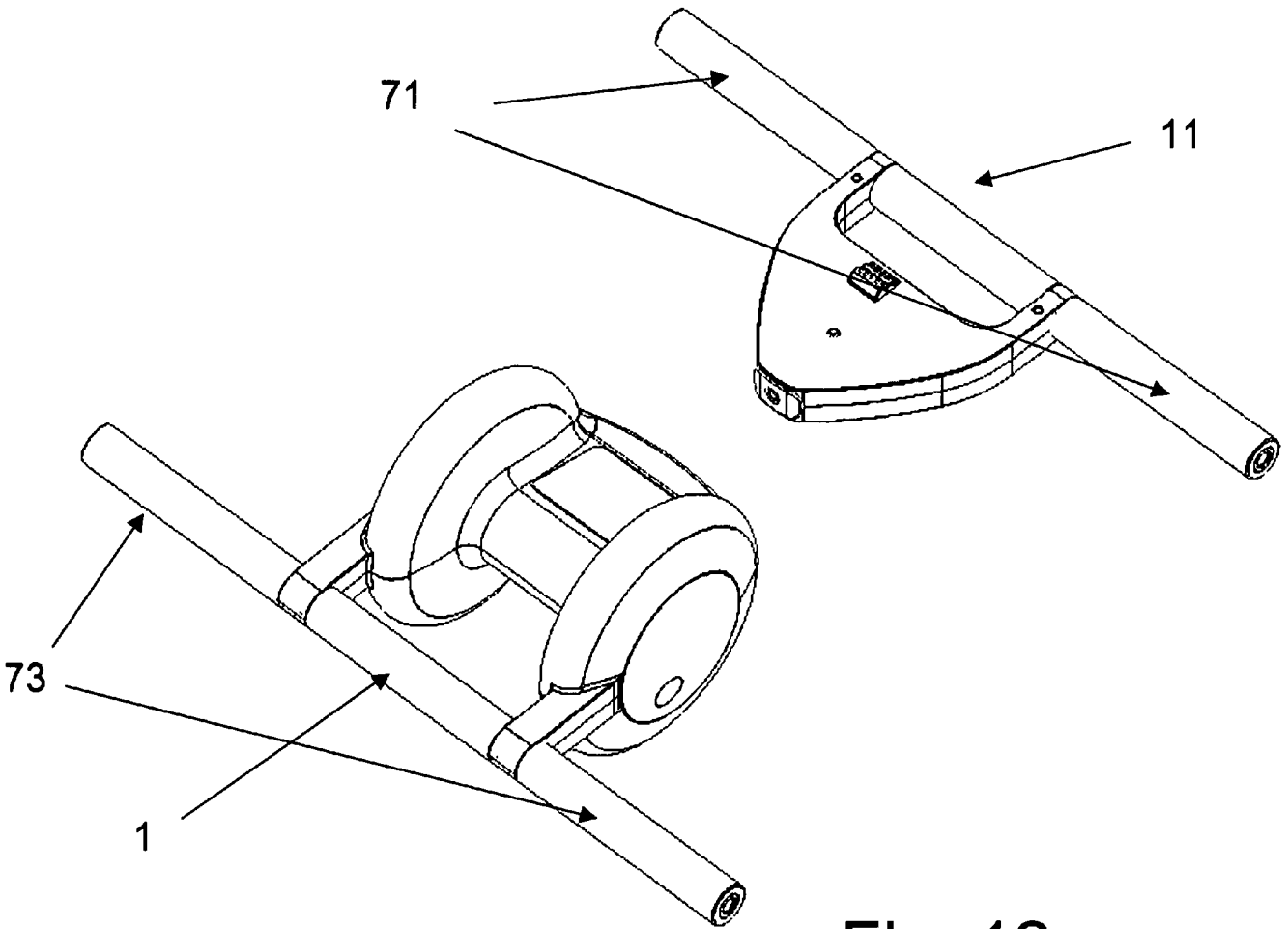
FIG. 12 shows the two parts of system with additional hand and foot attachments.

FIG. 12 shows the extra attachment (73) to the flywheel unit and the extra attachments (71) to the handle unit These attachments allow the user to perform more exercises, and use both hands and feet during the routines for example.

From the foregoing, it should be readily evident, that there has been provided a significantly improved simple lightweight method of making a variable resistance, and variable range exercise machine for major muscles of upper and lower body.

In view of the above, it will be seen that the several objects of the invention are achieved and other advantageous results are obtained. As various changes could be made in the above constructions without departing from the scope of the invention, it is intended that all matter contained in the above description or shown in the accompanying drawings shall be interpreted as illustrative and not in a limiting sense.

The invention claimed is:

1. A fitness device comprising:

a flywheel within a first handle assembly and being coupled to a first end of a cord, said flywheel being actuated through the tensioning of said cord through a second handle assembly attached to a second end of said cord; and a resistance indicator assembly within said second handle assembly, said resistance indicator assembly having a stationary block with a linear track extending therefrom and having a sliding block slidably spring loaded along said linear track, said sliding block being connected with a resistance indicator;

said cord extending from said flywheel to partially wrap about said sliding block such that the tensioning of said cord observably slides said sliding block thereby displaying the level of resistance provided by said flywheel.

2. The fitness device of claim 1 wherein the observable displacement of said resistance indicator correlates with the resistance transmitted through said cord.

3. The fitness device of claim 1 further comprising a cord adjustment means with a cord retraction wheel configured to adjustably reel said cord in or out; said cord retraction wheel rotation selectively controlled by a ratcheting relationship between said cord retraction wheel and a pivoted lever pawl.

4. The fitness device of claim 3 wherein said cord adjustment means is adjustably reeled by an accessible knob having indicia corresponding to the set said cord length.

5. The fitness device of claim 3 wherein said cord adjustment means includes a release button configured to disengage said pivoted lever pawl from said cord retraction wheel to permit the selective reeling out of said cord.

6. The fitness device of claim 1 wherein said second handle assembly is configured to be engaged by a hand or a foot.

* * * * *